United States Patent [19]

Benites

[11] Patent Number: 5,037,343

[45] Date of Patent: Aug. 6, 1991

[54] NOVELTY SCENT SIMULATING FIGURE

[76] Inventor: Lorie K. Benites, R.D. 2, Box 120, Cochranville, Pa. 19330

[21] Appl. No.: 568,905

[22] Filed: Aug. 17, 1990

[51] Int. Cl.[5] ..... A63H 3/00

[52] U.S. Cl. ..... 446/268; 446/296; 446/369; 428/905

[58] Field of Search ..... 446/268, 296, 369, 74; 428/905; 239/34, 57, 58, 211

[56] References Cited

U.S. PATENT DOCUMENTS

| | | | |
|---|---|---|---|
| 2,618,892 | 11/1952 | Locks et al. | 446/268 |
| 4,345,716 | 8/1982 | Armstrong et al. | 428/905 |
| 4,419,395 | 12/1983 | Sugimoto | 428/905 |
| 4,612,223 | 9/1986 | Spector | 428/905 |
| 4,695,264 | 9/1987 | McLeod, Jr. | 446/369 |
| 4,746,567 | 5/1988 | Zelter | 428/905 |
| 4,898,633 | 2/1990 | Doree et al. | 428/905 |

*Primary Examiner*—Robert A. Hafer
*Assistant Examiner*—David J. Kenealy
*Attorney, Agent, or Firm*—Leon Gilden

[57] ABSTRACT

A figure is provided for educational and entertaining purposes in providing a skunk-like figure, with a tail member extending rearwardly of the skunk, with the tail member including a cavity therewithin. The cavity includes a matrix of slits therethrough for directing an aromatic scent selectively from the tail by microcapsules to contain a scented liquid.

1 Claim, 3 Drawing Sheets

NOVELTY SCENT SIMULATING FIGURE

BACKGROUND OF THE INVENTION

1. Field of the Invention

The field of invention relates to novelty figures, and more particularly pertains to a new and improved novelty scent simulating figure that selectively effects directing of an aromatic scent from a tail section of the figure.

2. Description of the Prior Art

Figures of various configurations and types have been set forth in the prior art for educational and amusement purposes. The instant invention sets forth a figure that selectively permits directing of a scent therefrom in simulation of a skunk-like member. Examples of such prior art may be found in U.S. Pat. No. 2,474,236 to Durbin setting forth a novelty ornament in a skunk-like configuration.

U.S. Design Pat. Nos. 288,480; 266,938; and 255,811 are further Examples of animal figure construction members. Further, U.S. Pat. No. 4,338,465 to Isbell sets forth a synthesized scent similar to that as set forth in skunks.

U.S. Pat. No. 4,746,567 sets forth the teaching of a microcapsule to contain a scent.

As such, it may be appreciated that there continues to be a need for a new and improved novelty scent simulating figure which addresses both the problems of ease of use as well as effectiveness in construction and in this respect, the present invention substantially fulfills this need.

SUMMARY OF THE INVENTION

In view of the foregoing disadvantages inherent in the known types of novelty figure members now present in the prior art, the present invention provides a novelty scent simulating figure wherein the same permits selective directing of a scented aromatic odor from an associated skunk-like tail. As such, the general purpose of the present invention, which will be described subsequently in greater detail, is to provide a new and improved novelty scent simulating figure which has all the advantages of the prior art novelty figures and none of the disadvantages.

To attain this, the present invention provides a figure for educational and entertaining purposes in providing a skunk-like figure, with a tail member extending rearwardly of the skunk, with the tail member including a cavity therewithin. The cavity includes a matrix of slits therethrough for directing an aromatic scent selectively from the tail by microcapsules to contain a second liquid.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved novelty scent simulating figure which has all the advantages of the rior art novelty figures and none of the disadvantages.

It is another object of the present invention to provide a new and improved novelty scent simulating figure which may be easily and efficiently manufactured and marketed.

It is a further object of the present invention to provide a new and improved novelty scent simulating figure which is of a durable and reliable construction.

An even further object of the present invention is to provide a new and improved novelty scent simulating figure which is susceptible of a low cost of manufacture with regard to both materials and labor, and which accordingly is then susceptible of low prices of sale to the consuming public, thereby making such novelty scent simulating figures economically available to the buying public.

Still yet another object of the present invention is to provide a new and improved novelty scent simulating figure which provides in the apparatuses and methods of the prior art some of the advantages thereof, while simultaneously overcoming some of the disadvantages normally associated therewith.

Still another object of the present invention is to provide a new and improved novelty scent simulating figure wherein the same contains a predetermined quantity of selectively actuated scented material to effect a scent directed from the figure's tail portion.

These together With other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
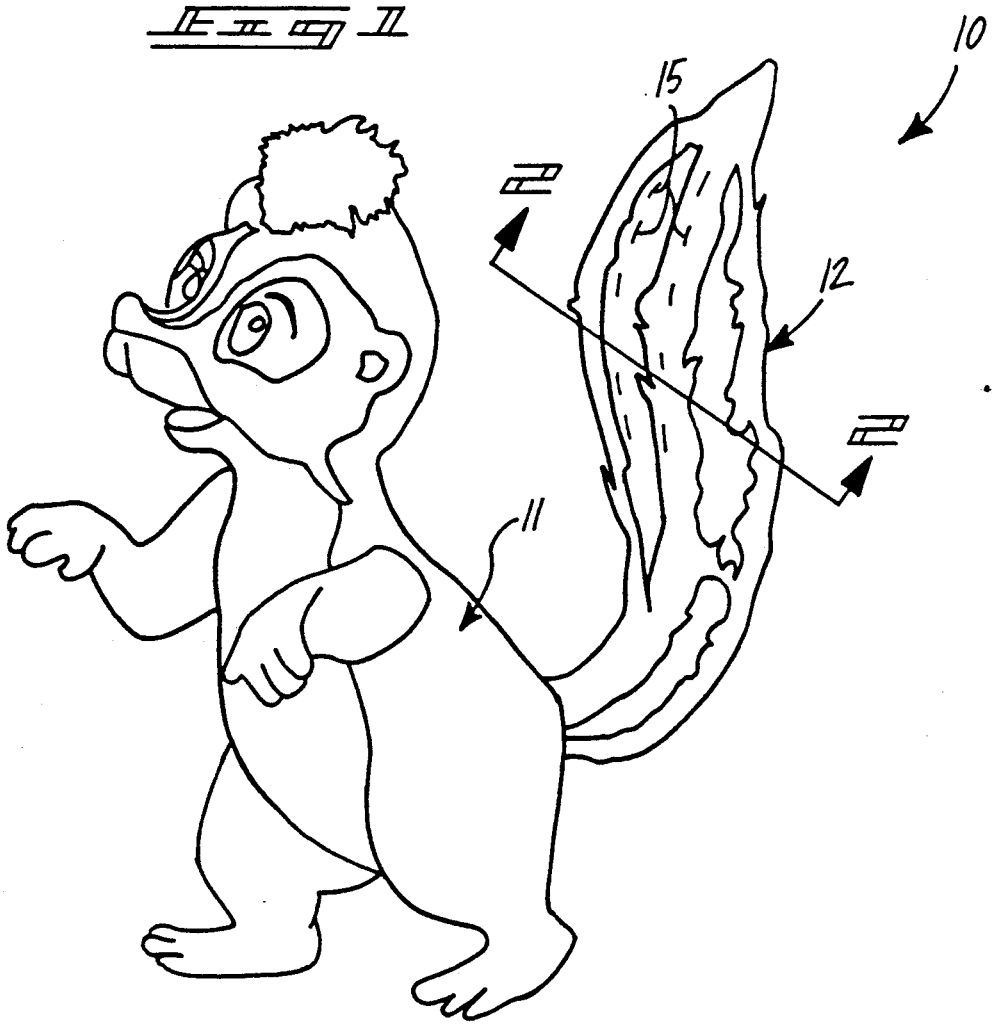
FIG. 1 is an isometric illustration of the instant invention.
Figure 2:
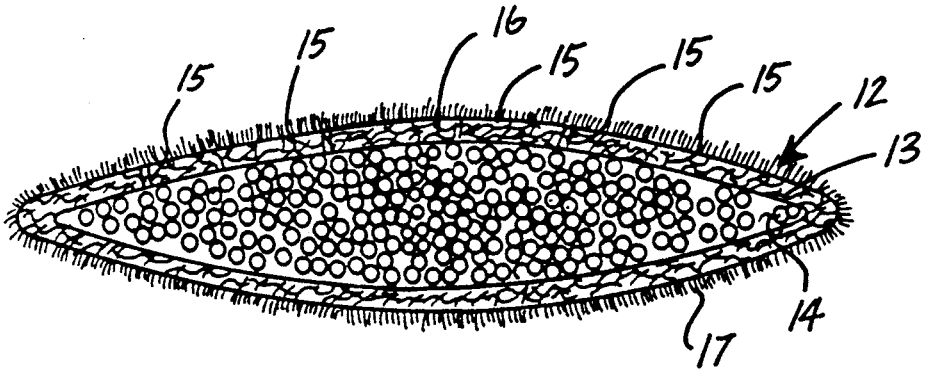
FIG. 2 is an orthographic view taken along the lines 2—2 of FIG. 2 in the direction indicated by the arrows.

With reference now to the drawings, and in particular to FIGS. 1 to 6 thereof, a new and improved novelty scent simulating figure embodying the principles and concepts of the present invention and generally designated by the reference numeral 10 will be described.

More specifically, the novelty scent simulating figure 10 of the instant invention essentially comprises a main body member 11, including an elongate tail section 12 fixedly mounted to the main body 11 adjacent a lower terminal end thereof and extending rearwardly and upwardly relative to the body member. The tail section includes an elongate flexible enclosed sheath 13 defining an elongate cavity 14 therewithin. A matrix of slits 15 are directed through a forward surface of the sheath 13 to include a predetermined quantity of microcapsules 16. The microcapsules 16 are of a type as utilized in U.S. Pat. No. 4,746,567 incorporated herein by reference utilizing a scented material as set forth in U.S. Pat. No. 4,338,468 also incorporated herein by reference.

Figure 3:
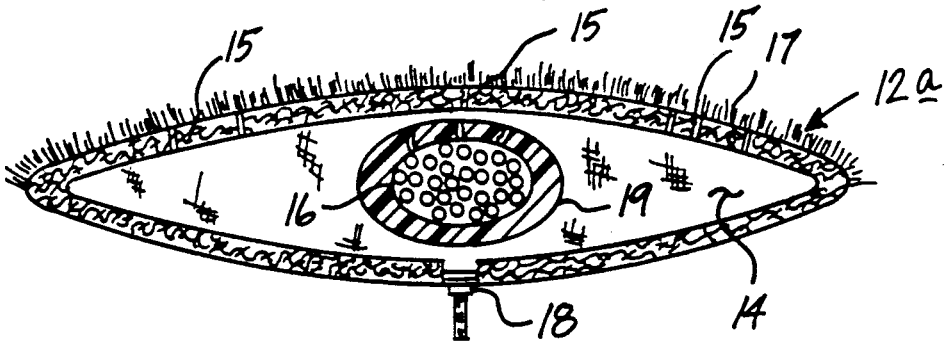
FIG. 3 is a modification of the tail member of the instant invention utilizing a zipper to attain access to a cavity therewithin.
Figure 4:
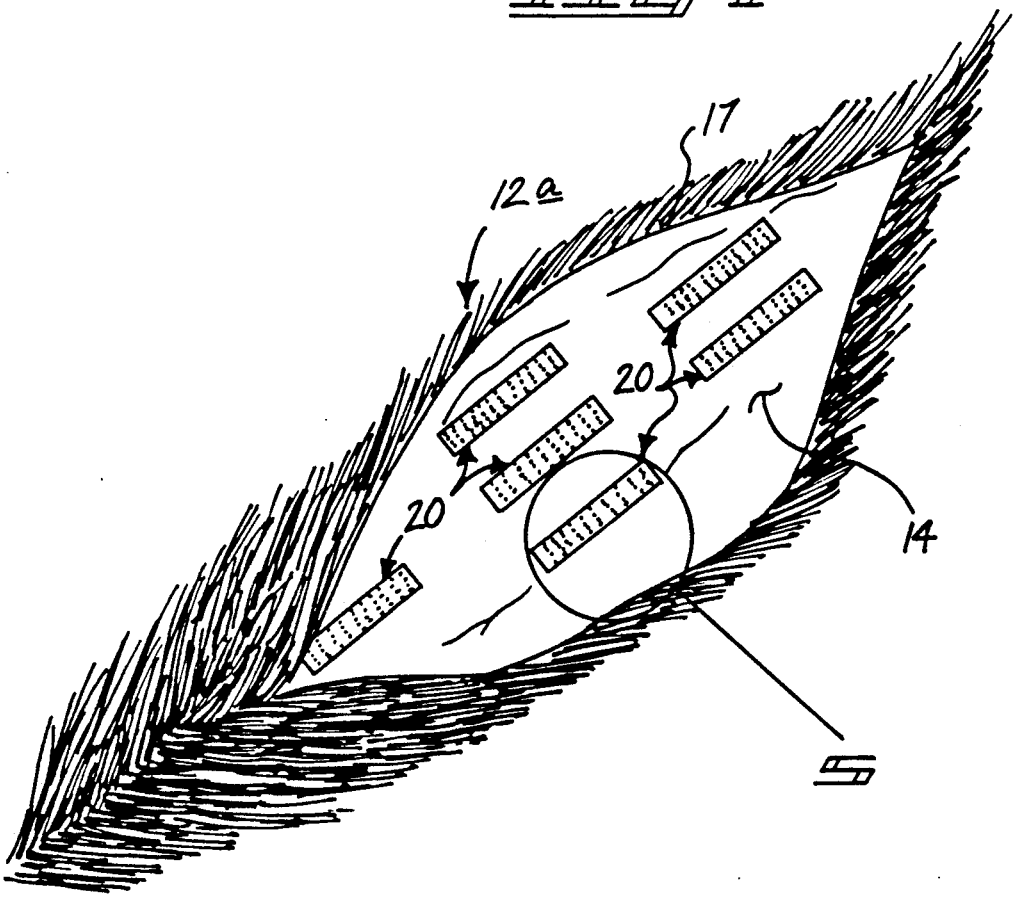
FIG. 4 is an orthographic bottom view of the tail-like portion of the figure illustrating the cavity therewithin.
Figures 5, 6:
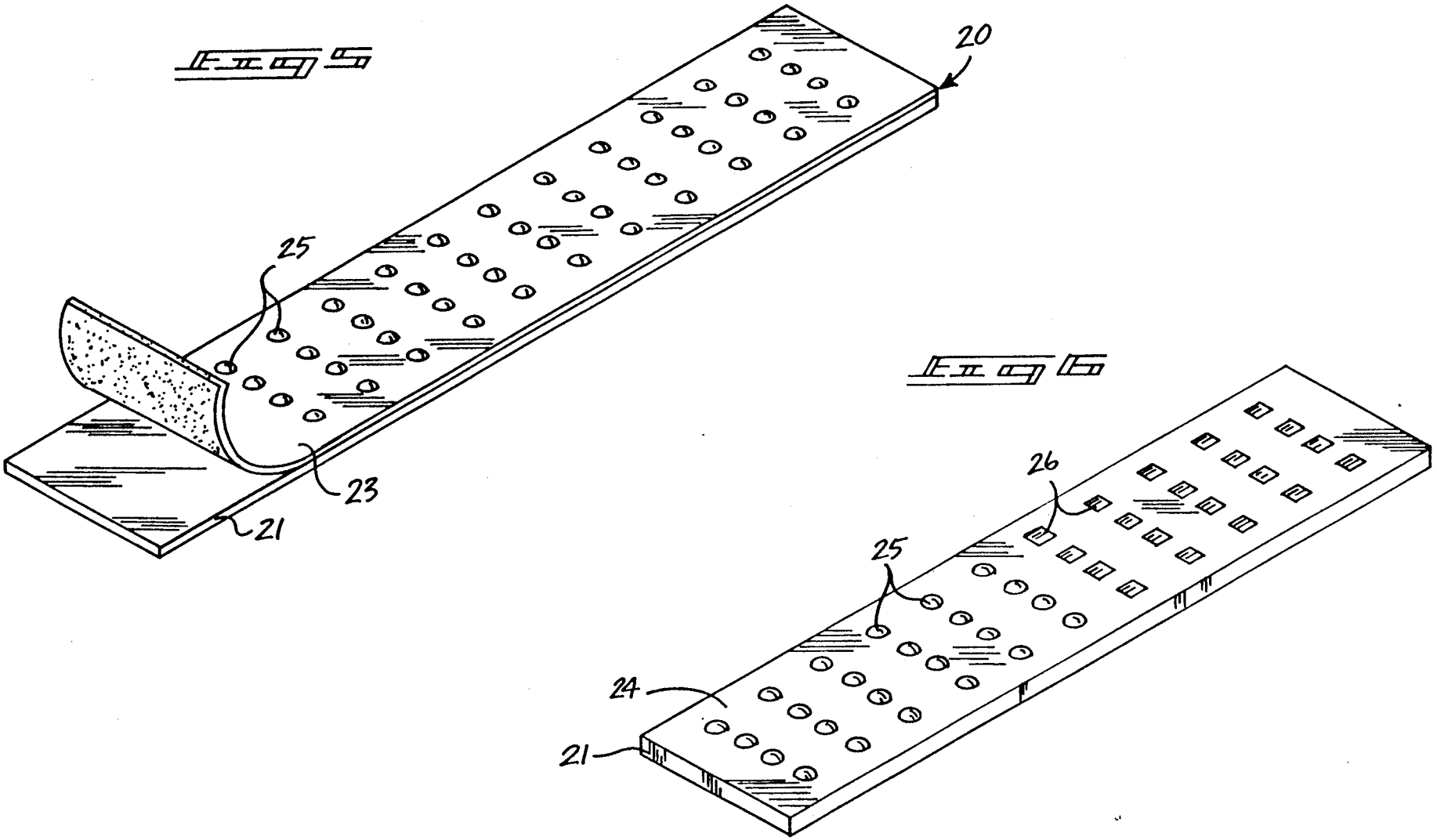
FIGS. 5 and 6 are isometric illustrations of scent containing strips for mounting within the tail section of the instant invention.

The sheath 13 includes a fibrous covering 17 to mask the slits 15 in their orientation within the forward surface of the sheath. FIG. 3 illustrates the use of an elongate zipper 18 longitudinally directed through a rear surface of the sheath to gain access to the elongate cavity 14. If desired, loosely contained within the sheath, a permeable tube 19 is provided, wherein the tube may be replaced by various scents, as desired by an individual, containing the microcapsules 16. FIG. 4 illustrates the use of scent strips 20 secured to the interior surface of the elongate cavity 14, and including a series of removable strips 23 (see FIG. 5) or in combination with removable strips defined by a second removable strip 24. The first removable strip includes first microcapsule members 25 mounted thereon containing a scented fluid therewithin of an unpleasant type, as set forth in U.S. Pat. No. 4,338,465, wherein second microcapsule members 26 of a second configuration to distinguish them from the first capsule members 25 of the first configuration may provide for a perfume like liquid to counteract and mask prolonged effects and usage of a repulsive type scent, as utilized in U.S. Pat. No. 4,338,465, and contained within the first capsule members 25.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A novelty scent simulating figure comprising, a main body member, the main body member including an elongate tail section mounted to the main body member, wherein the tail section includes an elongate fibrous flexible enclosed sheath, the sheath defining an elongate cavity therewithin, and microcapsules containing a scented fluid contained within the elongate cavity, and wherein the tail section includes a forward surface and a rear surface, and the forward surface includes a matrix of slits directed through the forward surface to permit directing of an aroma from the microcapsules exteriorly of the elongate cavity when the microcapsules are crushed, and wherein the tail section includes an elongate zipper extending longitudinally through the rear surface of the tail section to gain access to the cavity, and including a plurality of scent strips, the scent strips each including an elongate semi-rigid base, each base secured interiorly of the sheath within the cavity, and each strip including a matrix of the microcapsules mounted thereon, and wherein the strip is removably mounted to the base and includes a first matrix of microcapsule members, including a first aromatic fluid therewithin, and including a second matrix of microcapsules mounted on the strip, including a second aromatic fluid of a distinct aromatic character, as opposed to the first microcapsules.

* * * * *